US008900375B2

(12) United States Patent
Gnadinger et al.

(10) Patent No.: US 8,900,375 B2
(45) Date of Patent: Dec. 2, 2014

(54) TWO LEVEL CONDUIT DOCKING PORT MECHANISM FOR A DISHWASHING APPLIANCE

(75) Inventors: Errin Gnadinger, Louisville, KY (US); Satish Kumar Raju Buddharaju, Louisville, KY (US)

(73) Assignee: General Electric Company, Schenectady, NY (US)

( * ) Notice: Subject to any disclaimer, the term of this patent is extended or adjusted under 35 U.S.C. 154(b) by 706 days.

(21) Appl. No.: 13/233,395

(22) Filed: Sep. 15, 2011

(65) Prior Publication Data

US 2013/0068265 A1 Mar. 21, 2013

(51) Int. Cl.
*B08B 3/00* (2006.01)
*A47L 15/50* (2006.01)

(52) U.S. Cl.
CPC ..... *A47L 15/508* (2013.01)
USPC ..... 134/56 D; 135/57 D

(58) Field of Classification Search
CPC ..... A47L 15/4221
See application file for complete search history.

(56) References Cited

U.S. PATENT DOCUMENTS

| | | | | |
|---|---|---|---|---|
| 6,612,009 | B1 | 9/2003 | Laszczewski, Jr. et al. | |
| 2008/0271765 | A1* | 11/2008 | Burrows | 134/172 |
| 2009/0009040 | A1* | 1/2009 | Dellby et al. | 312/228.1 |
| 2009/0090400 | A1* | 4/2009 | Burrows et al. | 134/178 |
| 2009/0159101 | A1* | 6/2009 | Clerkin | 134/44 |

* cited by examiner

*Primary Examiner* — Jason Ko
(74) *Attorney, Agent, or Firm* — Dority & Manning, P.A.

(57) ABSTRACT

A two level conduit docking port for a dishwashing appliance is described. The docking port is provided having an upper port and a lower port, either of which is opened depending upon the position of a sliding valve that moves along the vertical direction. Movement of the valve to open either the upper port or the lower port is caused by contact between a protrusion on the sliding valve and a conduit attached to a height-adjustable rack. As such rack is pushed into the wash chamber of the dishwasher, the valve is moved vertically depending upon the vertical level of the rack.

18 Claims, 11 Drawing Sheets

TWO LEVEL CONDUIT DOCKING PORT MECHANISM FOR A DISHWASHING APPLIANCE

FIELD OF THE INVENTION

The subject matter of the present invention relates to a docking port for a dishwashing appliance.

BACKGROUND OF THE INVENTION

Dishwasher appliances generally have a wash chamber that includes one or more racks for the receipt of dishes, pots, pans, and other articles for washing. For example, an upper rack may be provided for glasses, cups, and smaller utensils while a lower rack provides for larger items such as pots, pans, and plates. In order to accommodate articles of different sizes, a mechanism for the height adjustment of one or more racks may be provided. One or more upper racks, for example, may be adjustable between different height levels in the dishwasher so that larger items can be placed either into the upper rack by adjusting it to a lower level, or to into the lower rack by adjusting the upper rack to a higher level. Other configurations for height adjustment of one or more racks may be used as well.

Frequently, one or more fluid supply conduits may be attached to the bottom wall of an upper rack in the dishwasher. This conduit may supply fluid to e.g., a spray arm assembly that provides wash fluid at a mid-level location in the dishwasher. For a dishwashing appliance with a front loading door, the racks are typically equipped to slide or roll along a horizontal direction to that the user can place or remove articles in the racks. As a result, where a conduit is attached to a movable rack, provision must be made for connecting the conduit with a fluid supply that is usually located toward the rear of the wash chamber. Preferably the connection with a fluid supply will be releasable and self-sealing so that it functions automatically as the user slides the rack assembly in or out of the dishwasher.

Where a rack assembly is height adjustable, challenges are created when providing such a connection for a fluid conduit carried on the rack assembly. These changes in height for the rack necessarily require that the connection point for the fluid conduit will also change height and, therefore, will contact the fluid supply at different locations. One approach to providing such a connection is to create multiple docking ports—each at a predetermined height along the rear wall of the wash chamber depending upon the fixed height levels for the rack. This approach requires that each docking port includes a sealing mechanism so that fluid is not released from one port when the conduit is connected to another port at a different level during operation of the dishwasher. Unfortunately, this can add unwanted complexity to the manufacture, assembly, and operation of the dishwasher.

Accordingly, a docking port for the connection of a conduit carried by a rack in a dishwashing appliance would be beneficial. More particularly, a docking port that can provide for connection of such conduit at different levels of the rack would be useful. Such a docking port that can also provide for sealing of the unused port would be useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a dishwashing appliance that includes a cabinet defining a wash chamber for the receipt of articles for washing and a rack for carrying the articles. The rack is configured for movement in and out of the cabinet for access by a user of the appliance. The rack is also configured for adjustment between an upper level and a lower level within the wash chamber. A conduit is attached to the rack and is movable with the rack in and out of the cabinet. The conduit has a connecting end oriented towards a rear wall of the wash chamber. A fluid supply is located along the rear wall of the chamber and defines an egress for the flow of fluid out of the fluid supply. A housing is positioned adjacent the egress of the fluid supply and defines an aperture for the flow through of fluid. A valve member is positioned between the fluid supply and the housing. The valve member defines a protrusion that extends through the aperture of the housing. The valve member is configured for sliding movement between i) a lower location where the aperture of the housing and the valve member align to define an upper port shaped to receive the connecting end of the conduit when the rack is in the upper level, and ii) an upper location where the aperture of the housing and the valve member align to define a lower port shaped to receive the connecting end of the conduit when the rack is in the lower level.

In another exemplary embodiment, the present invention provides a dishwashing appliance that includes a cabinet defining a wash chamber for the receipt of articles for washing and a rack for carrying the articles. The rack is configured for movement in and out of the cabinet for access by a user of the appliance. The rack is also configured for adjustment between an upper level and a lower level within the wash chamber. A conduit is attached to the rack and is movable with the rack in and out of the cabinet. The conduit has a connecting end oriented towards a rear wall of the wash chamber. A fluid supply is positioned along the rear wall of the wash chamber. A docking port mechanism is located along the fluid supply. The docking port mechanism includes a cover defining a vertically-oriented slot and a sliding member having a protrusion positioned between an upper edge and a lower edge. The sliding member is movable between i) an upper location where the lower edge and the cover define a lower port for receipt of the connecting end of the conduit and ii) a lower location where the upper edge and the cover define an upper port for receipt of the connecting end of the conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of the same or similar reference numerals in the figures indicates identical or similar features.

DETAILED DESCRIPTION OF THE INVENTION

Figure 1:
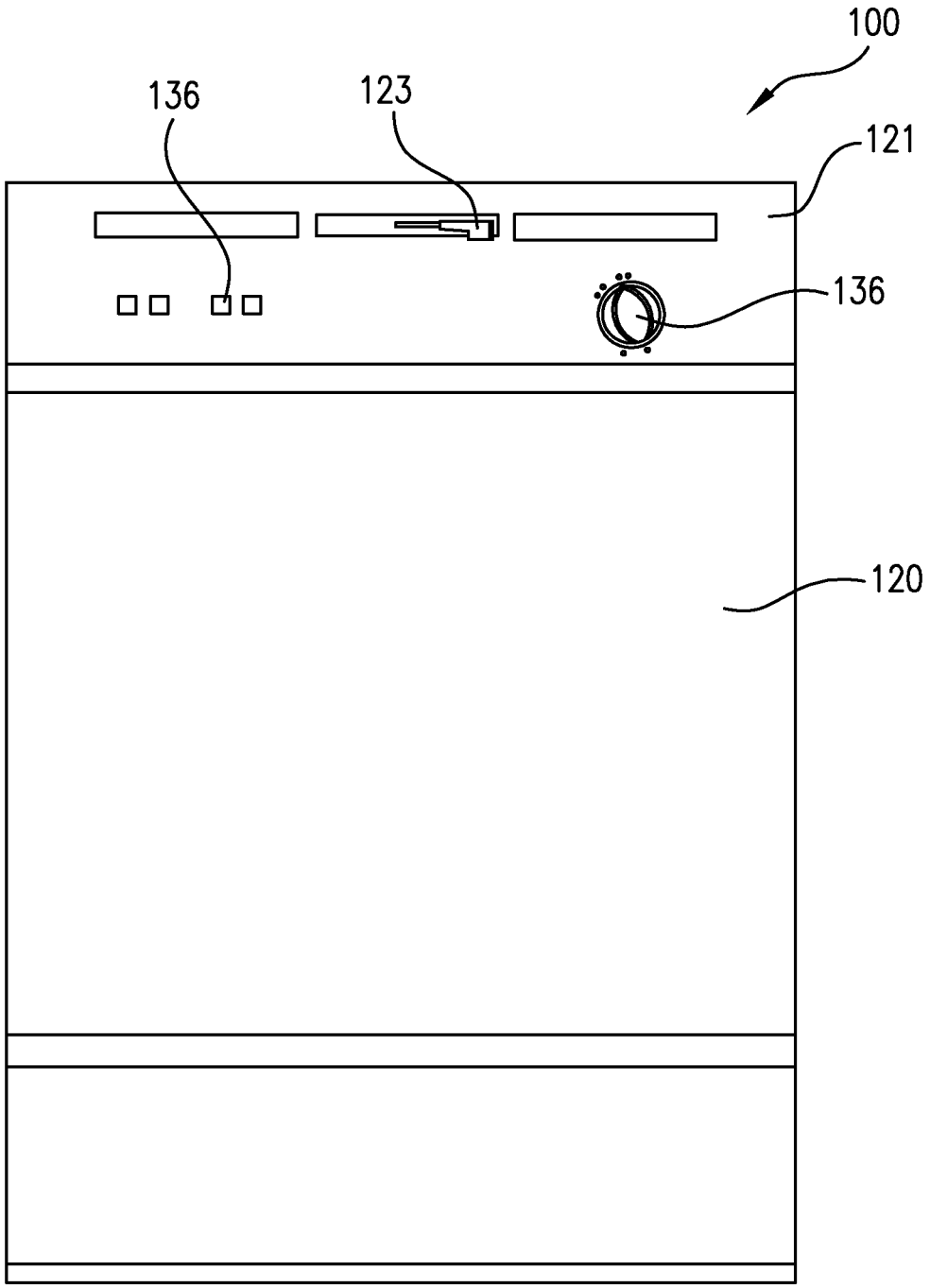
FIG. 1 provides a front view of an exemplary embodiment of a dishwasher appliance as may be used with the present invention.

The present invention provides a two level conduit docking port for a dishwashing appliance. More particularly, a docking port is provided having an upper port and a lower port, either of which is opened depending upon the position of a sliding valve that moves along the vertical direction. Movement of the valve to open either the upper port or the lower port is caused by contact between a protrusion on the sliding valve and a conduit attached to a height-adjustable rack. As such rack is pushed into the wash chamber of the dishwasher, the valve is moved vertically depending upon the vertical level of the rack.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
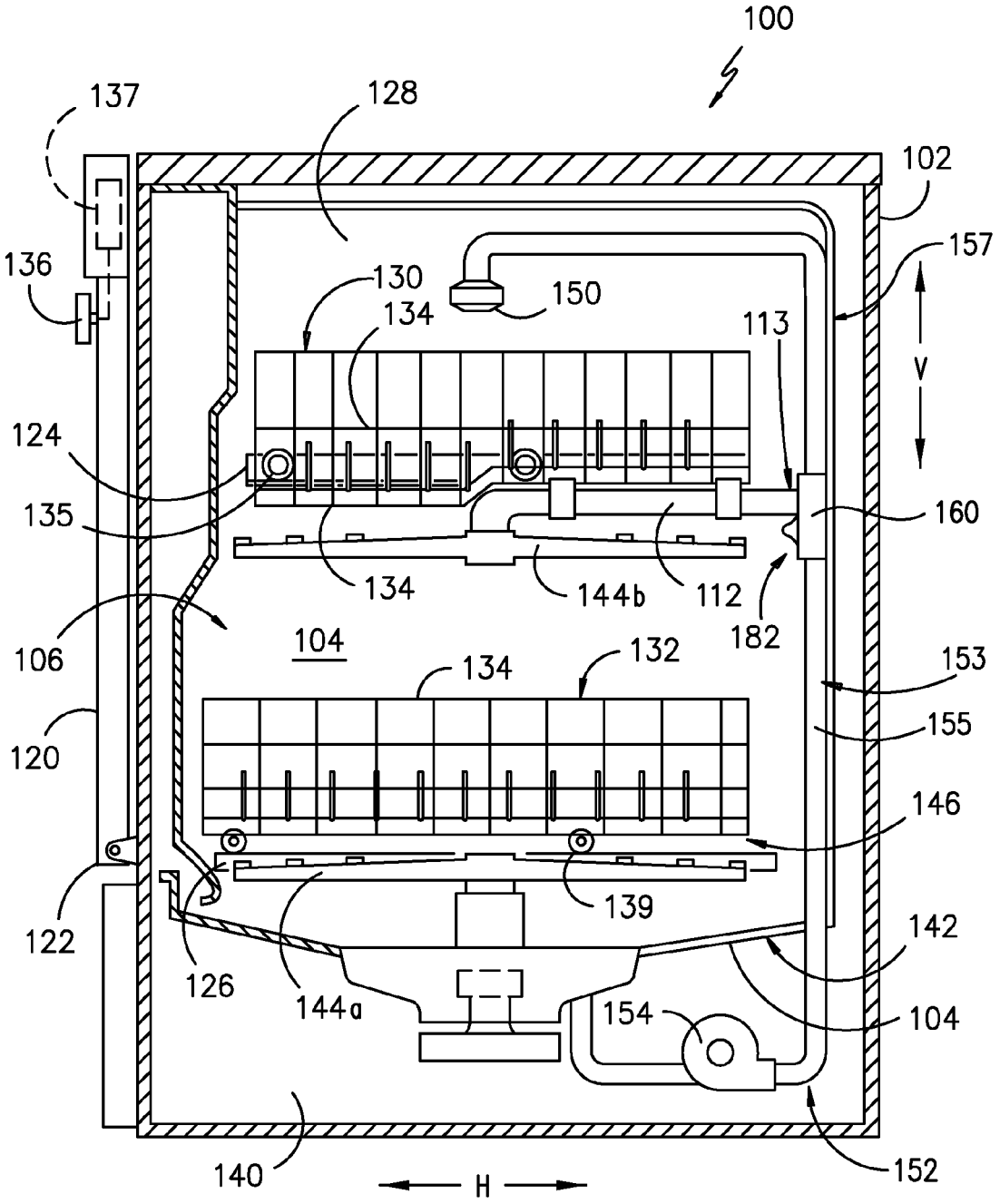
FIG. 2 provides a cross-sectional view of the dishwasher of FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 having a tub 104 that together define a wash chamber 106. The wash chamber 106 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

Upper rack assembly 130 is movable between a lower level and upper level along vertical direction V. As such, a user can adjust the vertical level of upper rack assembly 130 to accommodate larger utensils either in rack 130 or below in rack 132. A variety of mechanisms can be provided to allow for such adjustment of the rack assembly between levels as will be understood by one of skill in the art such that further description thereof is unnecessary.

The dishwasher 100 further includes a lower spray-arm assembly 144*a* that is rotatably mounted within a lower region 146 of the wash chamber 106 and above a tub sump portion 142 so as to rotate in relatively close proximity to rack assembly 132. A mid-level spray-arm assembly 144*b* is located in an upper region of the wash chamber 106 and is attached to, connected with, or integrated with upper rack 130. As upper rack 130 is slid in and out of wash chamber 106, mid-level spray arm assembly 144*b* moves with the rack 130 along with conduit 112 that provides wash or rinse fluids to assembly 144*b* from fluid supply 153. Conduit 112 includes a connecting end 113 that is oriented towards the rear wall of wash chamber 106. Additionally, an upper spray assembly 150 may be located above the upper rack 130.

The lower and mid-level spray-arm assemblies 144*a*, 144*b* and the upper spray assembly 150 are fed by a fluid circulation system 152 that provides for circulating dishwasher fluids (e.g., water, water and detergent) within chamber 106. The fluid circulation assembly 152 includes a pump 154 located in a machinery compartment 140 below the bottom sump portion 142 of the tub 104, as generally recognized in the art. Pump 154 is connected to a fluid supply 153 that, for this embodiment, is constructed as vertically oriented conduit 155 that extends along the rear wall 157 of chamber 106. Each spray-arm assembly 144*a*, 144*b* includes an arrangement of discharge ports or orifices for directing washing liquid onto dishes or other articles located in rack assemblies 130 and 132. The arrangement of the discharge ports in spray-arm assemblies 144*a*, 144*b* provides a rotational force by virtue of washing fluid flowing through the discharge ports. For example, the resultant rotation of the lower spray-arm assembly 144*a* provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. In addition, more than two racks—including multiple upper racks—may also be constructed with the present invention. Other configurations may be used as well.

FIGS. 3 through 7 illustrate an exemplary embodiment of a docking port mechanism 182 of the present invention. In this embodiment, a valve member 164 is positioned between cover or housing 160 and the vertically-oriented conduit 155 of fluid supply 153. Cover or housing 160 is positioned adjacent an egress 158 (FIGS. 6 and 7) formed on the front wall 163 of fluid supply 153. Cover or housing 160 also defines an aperture 162—in the shape of an elongated slot—for the flow of fluid from fluid supply 153, through egress 158, and into conduit 155.

Figure 4:
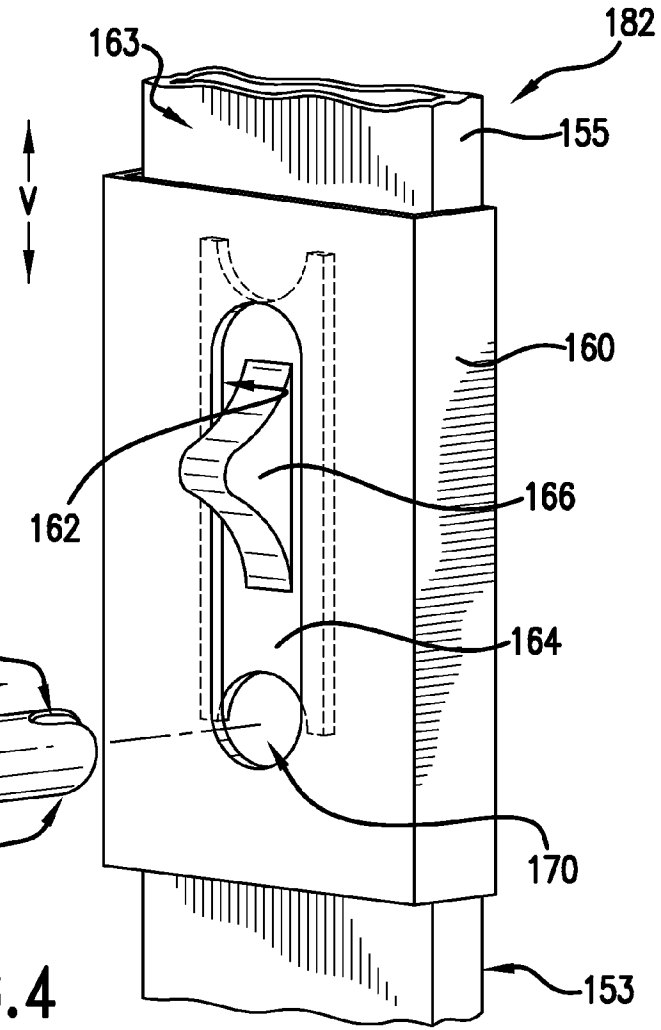
FIGS. 3 and 4 illustrate perspective views of an exemplary embodiment of a docking port of the invention in the lower and upper positions, respectively.
Figure 3:
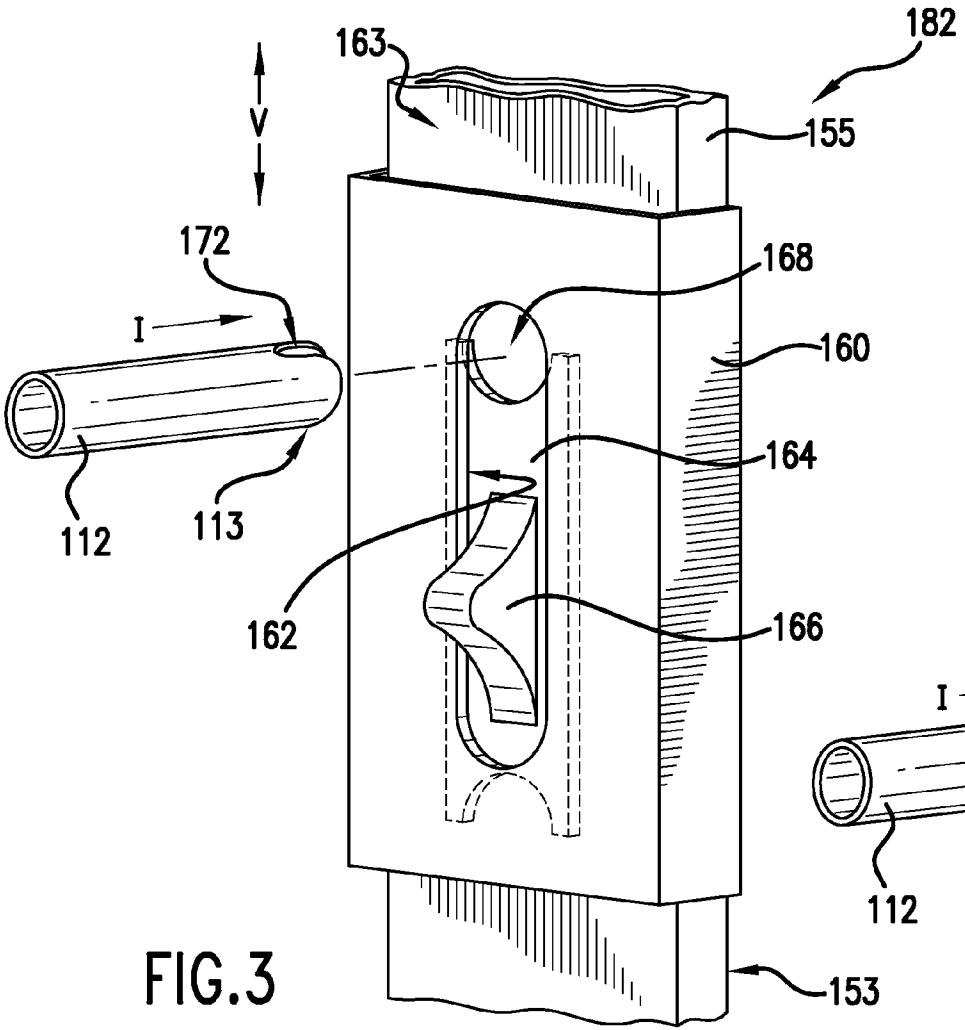
Figure 5:
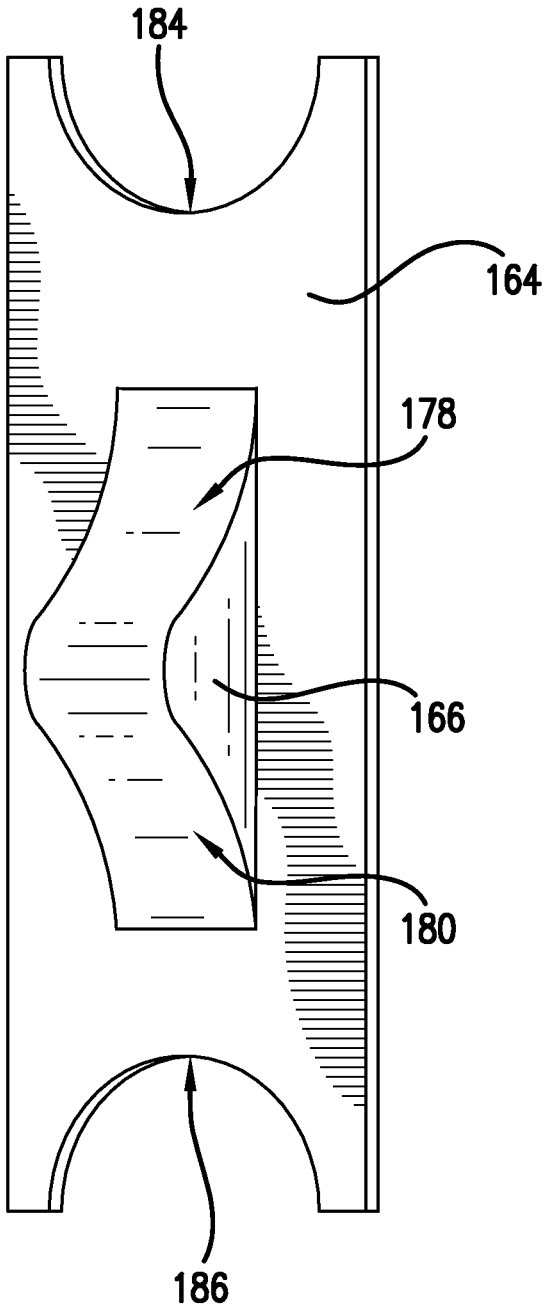
FIG. 5 is a perspective view of an exemplary embodiment of a sliding valve of the present invention as used in the embodiments of FIGS. 3 and 4.
Figure 6:
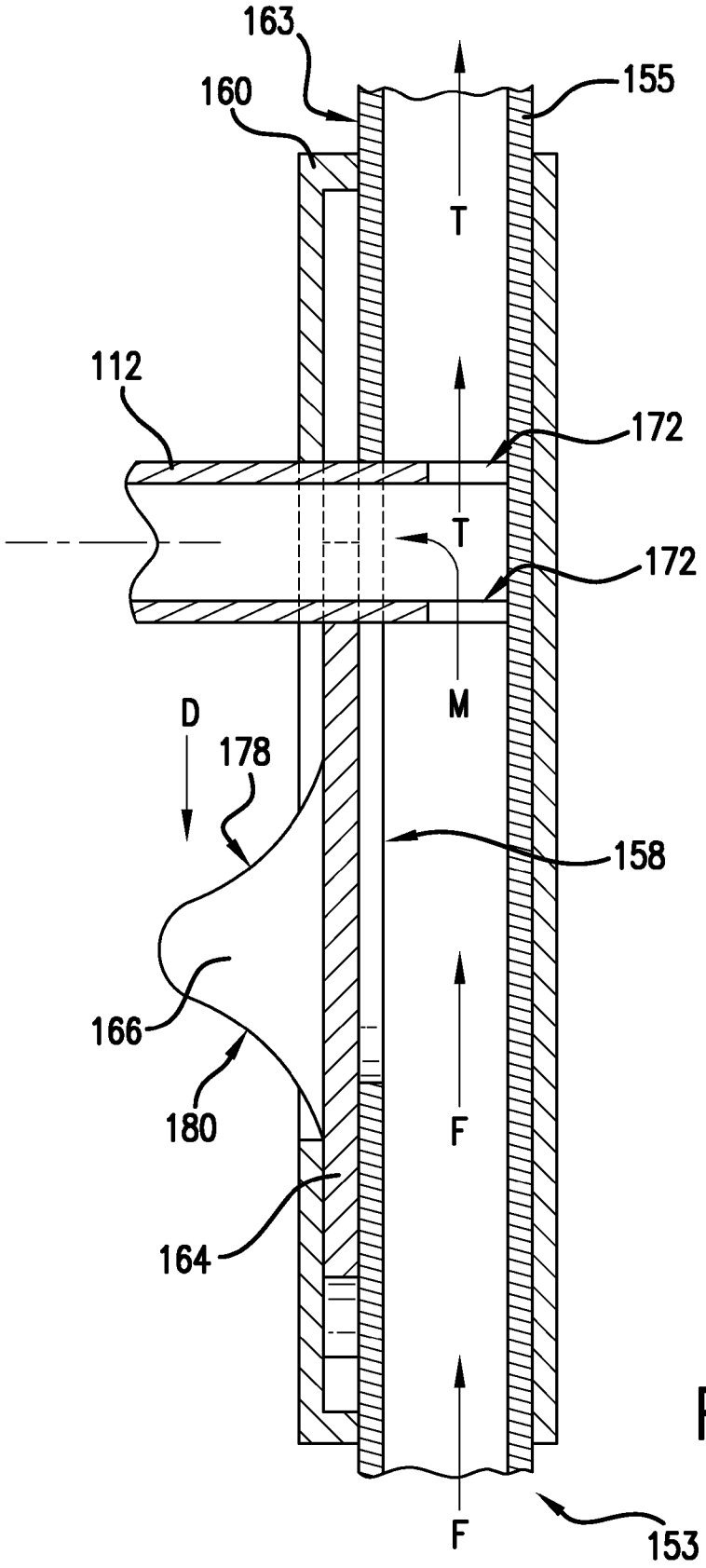
FIGS. 6 and 7 illustrate cross-section views of the exemplary embodiment of a docking port (as also shown in FIGS. 3 and 4) in the lower and upper positions, respectively.
Figure 7:
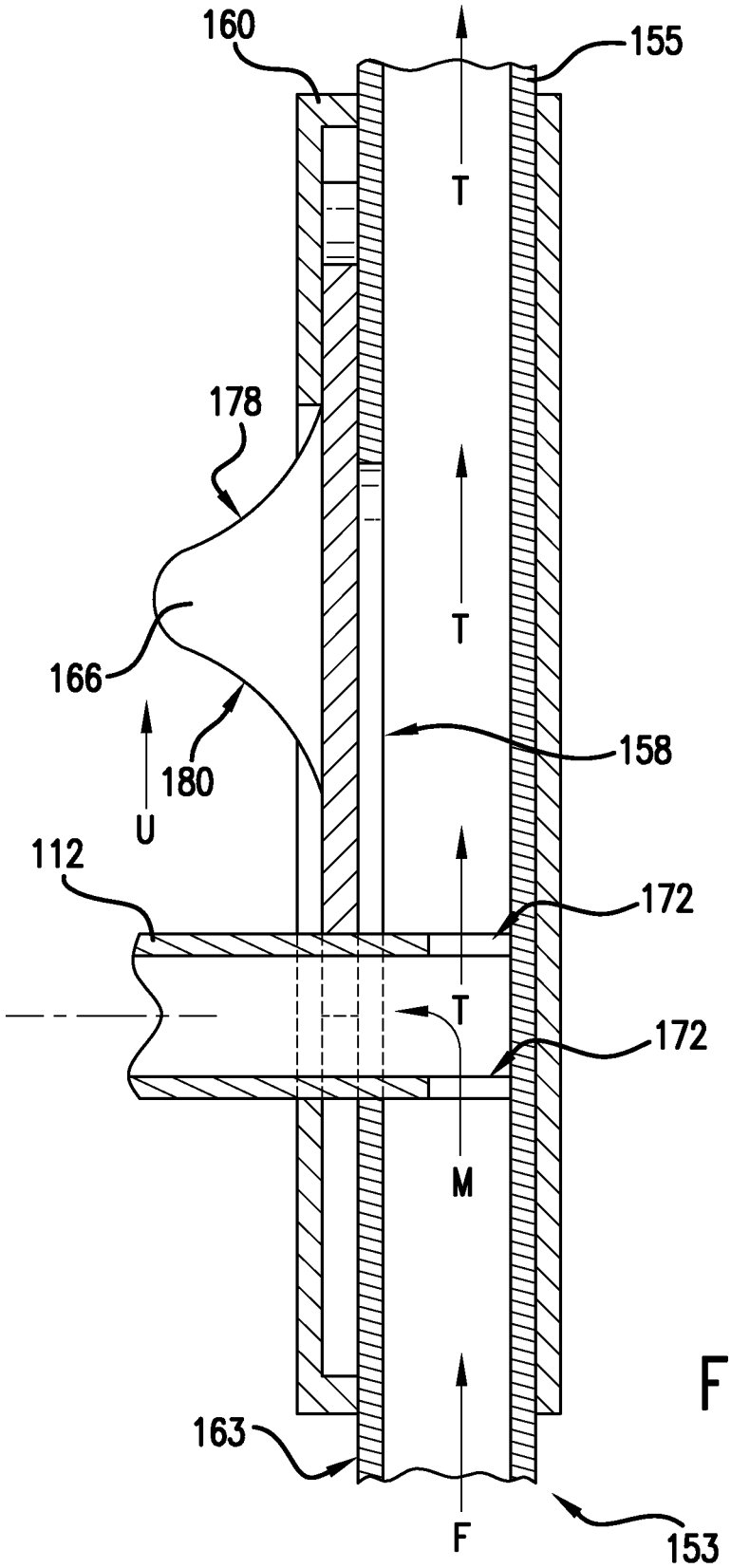
Figure 9:
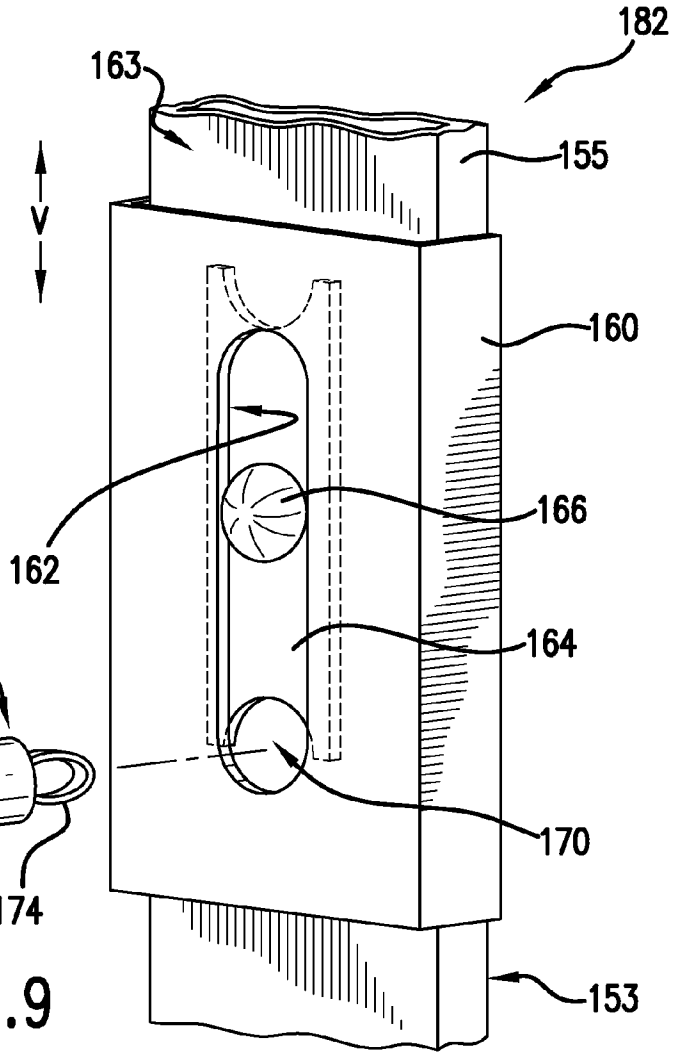
FIGS. 8 and 9 illustrate perspective views of an exemplary embodiment of a docking port of the invention in the lower and upper positions, respectively.

Valve member 164 defines a protrusion 166 that extends through aperture 162 and towards the connecting end 113 of conduit 112. Valve 164 acts as a sliding member that can move between a lower location as shown in FIGS. 3 and 6, and an upper location as shown in FIGS. 4 and 7. More particularly, in the lower location of FIGS. 3 and 6, the aperture 162 of cover or housing 160 and the upper edge 184 of valve member 164 together define an upper port 168 that is shaped to receive the connecting end 113 of conduit 112 when rack 130 in at an upper level. Conversely, in the upper location of as shown in FIGS. 4 and 7, the aperture 162 of cover or housing 160 and the lower edge 186 of valve member 164 define a lower port 170 that is shaped to receive the connecting end 113 of conduit 112 when rack 130 is moved to a lower level by the user. When upper port 168 is open, lower port 170 is closed to prevent fluid flow there through. Similarly, when lower port 170 is open, upper port 168 is closed to prevent fluid there through.

The movement of valve member 164 between the lower and upper positions is caused by a pressing contact force that is applied by the connecting end 113 of conduit 112 whenever upper rack assembly 130 is pushed into the wash chamber 106 by a user of the appliance. Protrusion 166 defines an upper sloped surface 178 and a lower sloped surface 180. For this exemplary embodiment, sloped surfaces 178 and 180 are concave in shape. However, convex, linear, and other shapes may be used as well.

Figure 8:
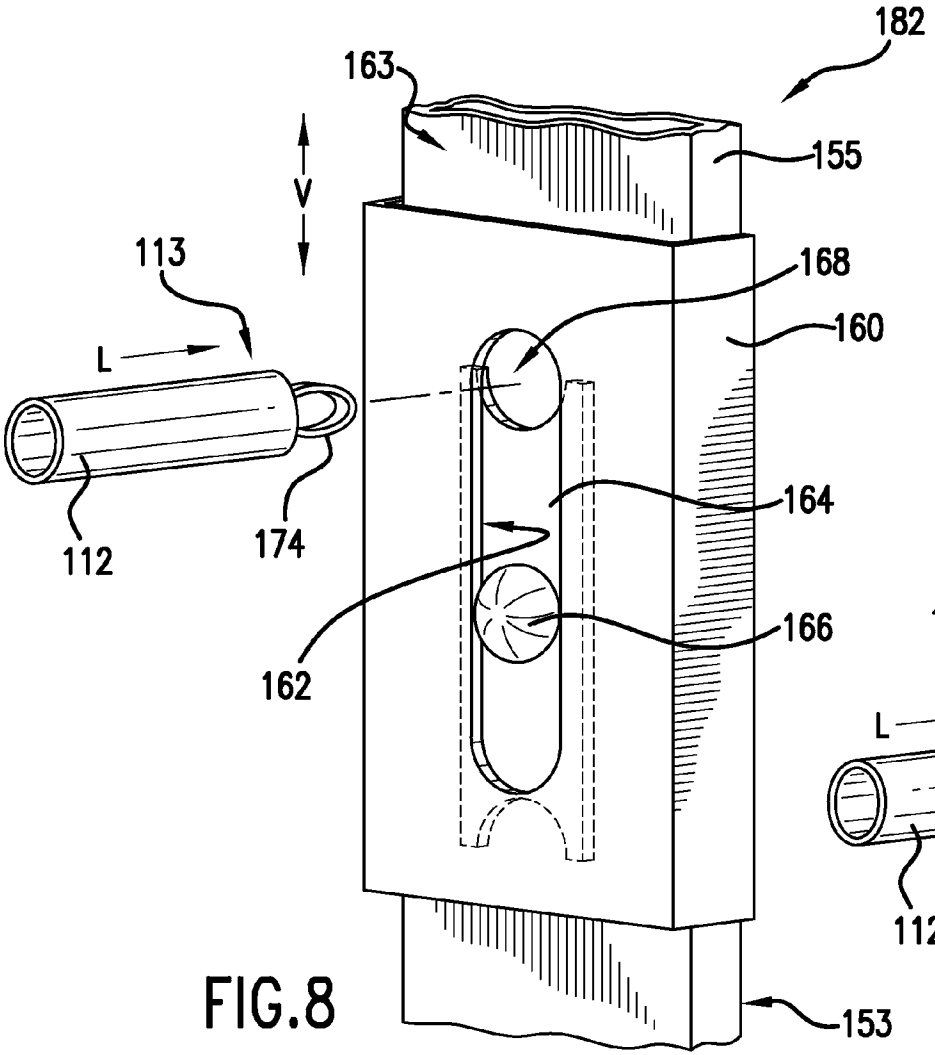
Figure 10:
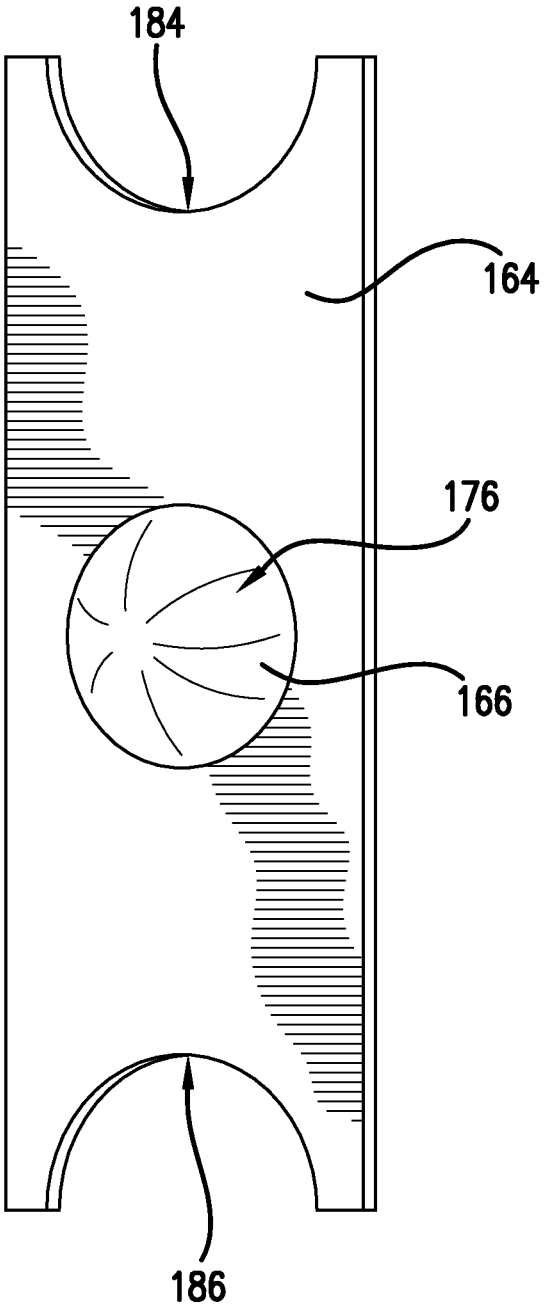
FIG. 10 is a perspective view of an exemplary embodiment of a sliding valve of the present invention as used in the embodiments of FIGS. 8 and 9.

Accordingly, as rack assembly 130 is pushed into chamber 106 (arrow I in FIG. 3), contact between connecting end 113 and surface 178 or surface 180 will cause valve member 164 to slide down (arrow D in FIG. 7) or slide up (arrow U in FIG. 8 depending upon the vertical level of assembly 130 as determined by the user. For example, if rack assembly 130 is at a higher level, connecting end 113 will impact surface 178, causing surface 178 to slide against connecting end 113 so that valve member 164 slides downward and connecting end 113 is inserted into upper port 168. If rack assembly 130 is at a lower level, connecting end 113 will impact surface 180, causing surface 180 to slide against connecting end 113 so that valve member 164 slides upward and connecting end 113 is inserted into lower port 170. Of course, if valve member 164 is already in the appropriate upper or lower position based on the level of rack assembly 130, then connecting end 113 will simply insert directly into port 168 or 170 without causing sliding movement of valve 164.

For the exemplary embodiment of FIGS. 3 through 7, connecting end 113 is configured with a slotted or grooved edge 172. As shown in FIGS. 6 and 7, this allows fluid to flow both into and past conduit 112 when it is positioned into one of ports 168 or 170 and against a wall of the conduit 155 of fluid supply 153. When conduit 112 is in the upper port 168 as shown in FIG. 6, fluid flow from pump 154 (arrows F) can flow into conduit 112 (arrow M) and can also continue to the upper spray assembly 150 (arrow T). Likewise, when conduit 155 is in the lower port 170 as shown in FIG. 7, fluid flow from pump 154 (arrows F) can flow into conduit 112 (arrow M) and can also continue to the upper spray assembly 150 (arrow T).

FIGS. 8 through 12 illustrate another exemplary embodiment of a docking port mechanism 182 of the present invention that operates similarly to the mechanism 182 of FIGS. 3 through 7. Again, valve member 164 is positioned between cover or housing 160 and the vertically-oriented conduit 155 of fluid supply 153. Cover or housing 160 is also positioned adjacent an egress 158 (FIGS. 11 and 12) formed on the front wall 163 of fluid supply 153. An aperture 162—in the shape of an elongated slot—is provided for the flow of fluid from fluid supply 153, through egress 158, and into conduit 155.

For the embodiment of FIGS. 8 through 12, valve member 164 defines a protrusion 166 that is shaped substantially in the form of a hemisphere with a contact surface 176. Instead of edge 172, connecting end 113 in this embodiment is equipped with a clip or loop 174 positioned inside conduit 112. The movement of valve member 164 between the lower and upper positions is caused by a pressing contact force that is applied by loop 174 whenever upper rack assembly 130 is pushed into the wash chamber 106 by a user of the appliance. Accordingly, as rack assembly 130 is pushed into chamber 106 (arrow L in FIG. 8), contact between loop 174 and surface 176 will cause valve member 166 to slide down (arrow D in FIG. 7) or slide up (arrow U in FIG. 8 depending upon the vertical level of assembly 130 as determined by the user.

For example, if rack assembly 130 is at a higher level, connecting end 113 will impact surface 176, causing surface 176 to slide against loop 174 so that valve member 164 slides downward and connecting end 113 is inserted into upper port 168. If rack assembly 130 is at a lower level, loop 174 will again impact surface 176, causing surface 180 to slide against connecting end 113 so that valve member 164 slides upward and connecting end 113 is inserted into lower port 170. If valve member 164 is already in the appropriate upper or lower position based on the level of rack assembly 130, then connecting end 113 will simply insert directly into port 168 or 170 without causing sliding movement of valve 164.

Figure 11:
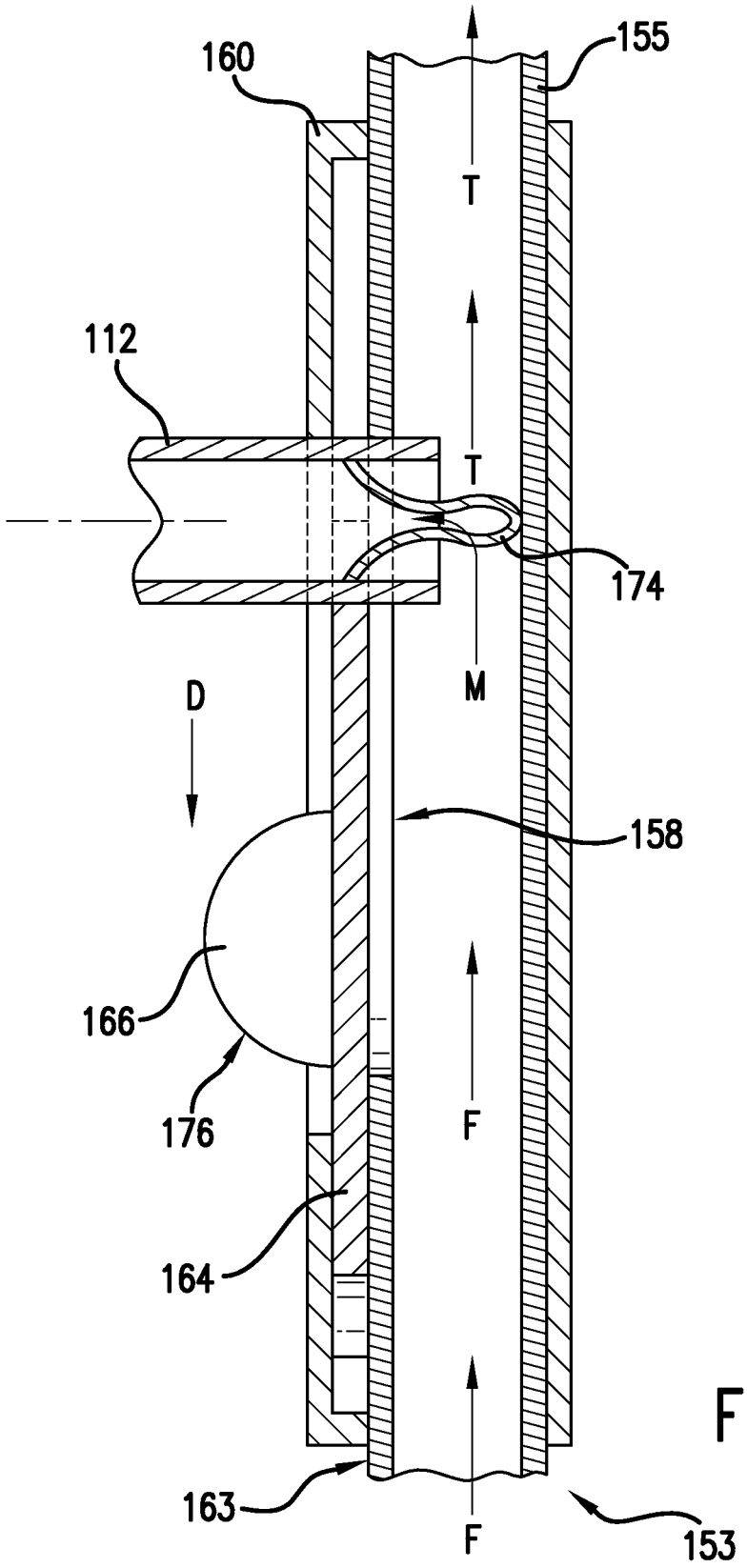
FIGS. 11 and 12 illustrate cross-sectional views of the exemplary embodiment of a docking port (as also shown in FIGS. 8 and 9) in the lower and upper positions, respectively.
Figure 12:
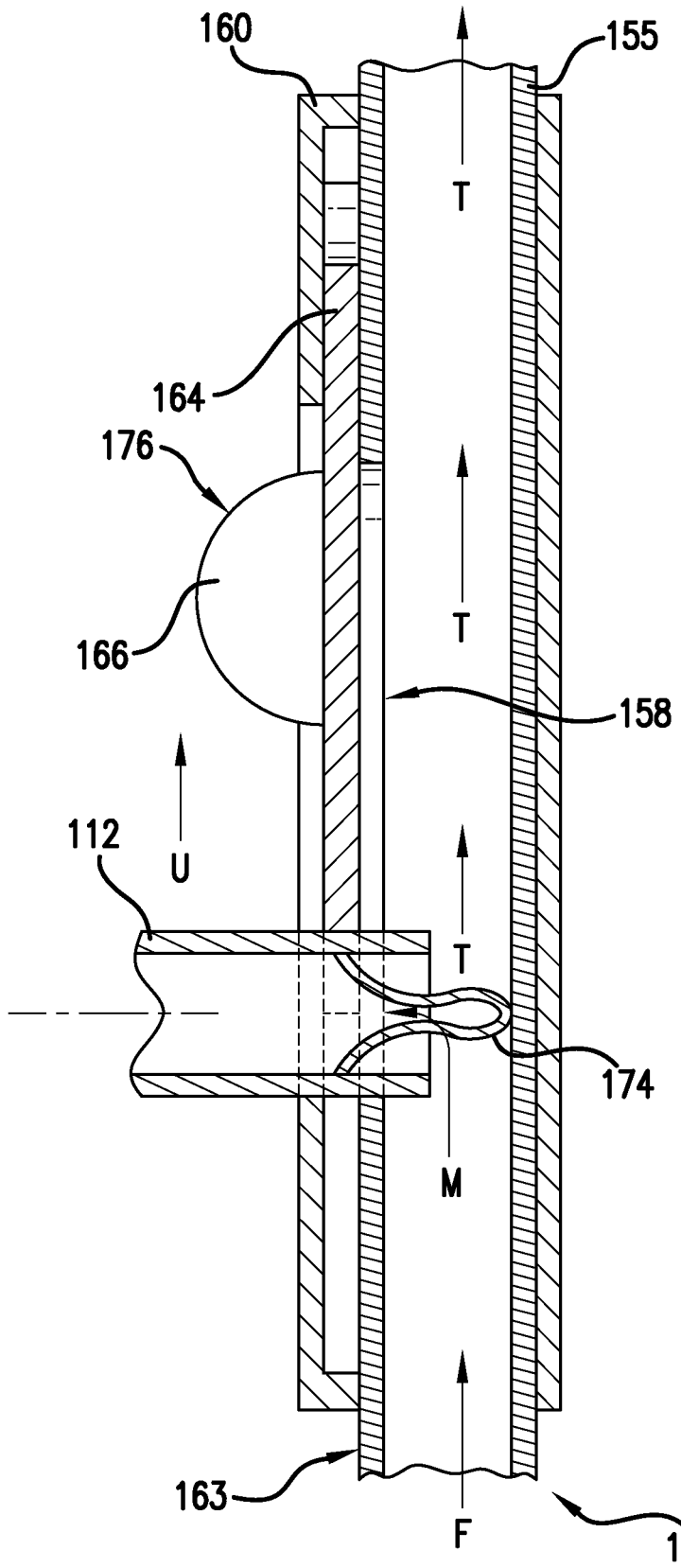

As shown in FIGS. 11 and 12, loop 174 allows fluid to flow both into and past conduit 112 when it is positioned into one of ports 168 or 170 and against a wall of the conduit 155 of fluid supply 153. When conduit 112 is in the upper port 168 as shown in FIG. 11, fluid flow from pump 154 (arrows F) can flow into conduit 112 (arrow M) and can also continue to the upper spray assembly 150 (arrow T). Likewise, when conduit 155 is in the lower port 170 as shown in FIG. 12, fluid flow from pump 154 (arrows F) can flow into conduit 112 (arrow M) and can also continue to the upper spray assembly 150 (arrow T).

Figure 13:
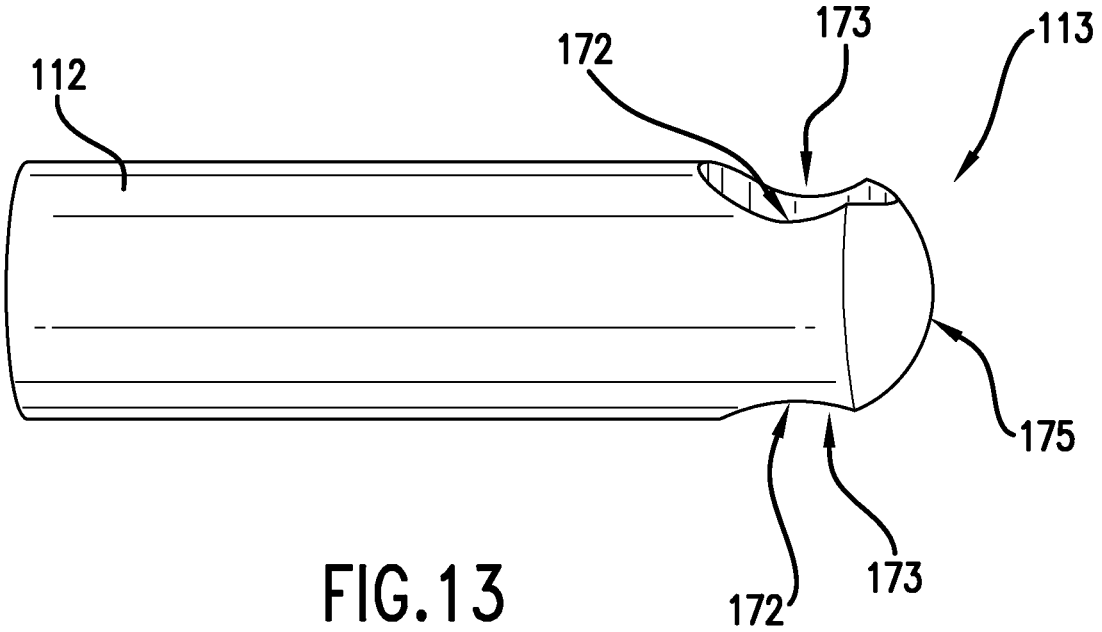
FIG. 13 provides another exemplary embodiment of a conduit as may be used to connect with a docking port.

Using the teachings disclosed herein, one of skill in the art will understand that other configurations and shapes for the edge 172 or loop 174 of conduit 112 may be applied to allow water to flow both into and past conduit 112 at the same time. By way of example only, FIG. 13 provides another example of a conduit 112 as may be used with the present invention. For this embodiment, connecting end 113 contains edges 172 that define openings 173 on opposing sides of conduit 112. A curved or arcuate surface 175 is provided for sliding contact with protrusion 166 of the above described embodiments. As will be understood by one of skill in the art using the teachings disclosed herein, other configurations may be also be used for conduit 112 that are within the scope of the claims that follow.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet defining a wash chamber for the receipt of articles for washing;

a rack for carrying the articles, said rack configured for movement in and out of the cabinet for access by a user of the appliance, said rack also configured for adjustment between an upper level and a lower level within the wash chamber;

a conduit attached to said rack and movable with said rack in and out of the cabinet, said conduit having a connecting end oriented towards a rear wall of the wash chamber;

a fluid supply located along the rear wall of the chamber and defining an egress for the flow of fluid out of said fluid supply;

a housing positioned adjacent the egress of said fluid supply, said housing defining an aperture for the flow through of fluid; and, a valve member positioned between said fluid supply and said housing, said valve member defining a protrusion that extends through the aperture of said housing, said valve member configured for sliding movement between i) a lower location where the aperture of said housing and said valve member align to define an upper port shaped to receive the connecting end of said conduit when said rack is in the upper level, and ii) an upper location where the aperture of said housing and said valve member align to define a lower port shaped to receive the connecting end of said conduit when said rack is in the lower level.

2. A dishwashing appliance as in claim 1, wherein said lower port is closed when said valve is in the upper location.

3. A dishwashing appliance as in claim 1, wherein said upper port is closed when said valve is in the lower location.

4. A dishwashing appliance as in claim 1, wherein the connecting end of said conduit has a grooved edge configured to allow fluid to flow both into said conduit and vertically along said fluid supply.

5. A dishwashing appliance as in claim 1, wherein the connecting end of said conduit has a loop extending from within said conduit and configured to allow fluid to flow both into said conduit and vertically along said fluid supply.

6. A dishwashing appliance as in claim 1, wherein said housing is attached to said fluid supply.

7. A dishwashing appliance as in claim 1, wherein the protrusion has a substantially hemispherical surface positioned for contact with the connecting end of said conduit.

8. A dishwashing appliance as in claim 1, wherein the protrusion has at least two concave surfaces positioned for contact with the connecting end of said conduit.

9. A dishwashing appliance as in claim 1, wherein said fluid supply extends vertically along the rear wall and within the wash chamber.

10. A dishwashing appliance as in claim 1, wherein said conduit is connected to a spray arm assembly.

11. A dishwashing appliance, comprising:

a cabinet defining a wash chamber for the receipt of articles for washing;

a rack for carrying the articles, said rack configured for movement in and out of the cabinet for access by a user of the appliance, said rack also configured for adjustment between an upper level and a lower level within the wash chamber;

a conduit attached to said rack and movable with said rack in and out of the cabinet, said conduit having a connecting end oriented towards a rear wall of the wash chamber;

a fluid supply positioned along the rear wall of the wash chamber; and, a docking port mechanism located along said fluid supply; said docking port mechanism comprising:

a cover defining a vertically-oriented slot;

a sliding member having a protrusion positioned between an upper edge and a lower edge, said sliding member movable between i) an upper location where the lower edge and said cover define a lower port for receipt of the connecting end of said conduit and ii) a lower location where the upper edge and said cover define an upper port for receipt of the connecting end of said conduit.

12. A dishwashing appliance as in claim 11, wherein said cover, said upper edge, and said lower edge of said sliding member form the upper port or lower port in a shape that corresponds with the connecting end of said conduit.

13. A dishwashing appliance as in claim 12, wherein said upper edge and said lower edge of said sliding member are each semi-circular in shape.

14. A dishwashing appliance as in claim 11, wherein said protrusion extends toward the connecting end of said conduit and has contact surface configured to move said sliding member towards either the upper location or the lower location upon a pressing contact with the connecting end of said conduit.

15. A dishwashing appliance as in claim 14, wherein the contact surface of said protrusion is substantially hemispherical in shape.

16. A dishwashing appliance as in claim 14, wherein the contact surface of said protrusion is convex or concave in shape.

17. A dishwashing appliance as in claim 11, wherein the connecting end of said conduit has a grooved edge configured to allow fluid to flow both into said conduit and vertically along said fluid supply.

18. A dishwashing appliance as in claim 11, wherein the connecting end of said conduit has a loop extending from within said conduit and configured to allow fluid to flow both into said conduit and vertically along said fluid supply.

* * * * *